US009859080B2

(12) United States Patent
Sohn

(10) Patent No.: US 9,859,080 B2
(45) Date of Patent: Jan. 2, 2018

(54) MOLDED CASE CIRCUIT BREAKER

(71) Applicant: LSIS CO., LTD., Anyang-si, Gyeonggi-do (KR)

(72) Inventor: Jong Mahn Sohn, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 211 days.

(21) Appl. No.: 14/639,801

(22) Filed: Mar. 5, 2015

(65) Prior Publication Data

US 2015/0262778 A1 Sep. 17, 2015

(30) Foreign Application Priority Data

Mar. 17, 2014 (KR) ..... 10-2014-0031216

(51) Int. Cl.
*H01H 71/04* (2006.01)
*H01H 71/12* (2006.01)
(Continued)

(52) U.S. Cl.
CPC ..... *H01H 71/04* (2013.01); *H01H 71/12* (2013.01); *H01H 71/123* (2013.01);
(Continued)

(58) Field of Classification Search
CPC ..... H01H 71/04; H01H 71/12; H01H 71/123; H01H 2017/042; H01H 71/0228; H01H 83/02; H01H 2071/467
See application file for complete search history.

(56) References Cited

U.S. PATENT DOCUMENTS 4,004,201 A * 1/1977 DePuy ..... H02H 3/105 340/638
4,858,056 A * 8/1989 Russell ..... H02H 1/06 361/42
(Continued)

FOREIGN PATENT DOCUMENTS

CN 1111805 11/1995
CN 101071702 11/2007
(Continued)

OTHER PUBLICATIONS

State Intellectual Property Office of the People's Republic of China Application Serial No. 201510183923.X, Office Action dated Aug. 1, 2016, 5 pages.
(Continued)

*Primary Examiner* — Zeev V Kitov
(74) *Attorney, Agent, or Firm* — Lee, Hong, Degerman, Kang & Waimey

(57) ABSTRACT

Provided is a molded case circuit breaker eliminating the necessity to install a communication unit and a particular communication medium and allowing for checking an fault type from a front indication operation panel of an enclosure of a power distributing board or from a remote area by simply connecting two signal lines for transmitting a relay switching signal as an accident current indication signal, the circuit breaker comprises a relay assembly including a plurality of fault indicating relays installed in the circuit breaker and configured to generate a fault current indication signal by opening or closing a contact when the indication command signal of a fault current is received from the electronic trip unit, and a signal output terminal configured to output a fault type indication signal of the fault indicating relays to the outside of the circuit breaker.

10 Claims, 6 Drawing Sheets

(51) Int. Cl.

| | |
|---|---|
| *H01H 71/02* | (2006.01) |
| *H01H 83/02* | (2006.01) |
| *H01H 71/46* | (2006.01) |

(52) U.S. Cl.
CPC ..... *H01H 71/0228* (2013.01); *H01H 83/02* (2013.01); *H01H 2071/042* (2013.01); *H01H 2071/467* (2013.01)

(56) References Cited

U.S. PATENT DOCUMENTS

| | | | | |
|---|---|---|---|---|
| 2007/0236841 | A1 | 10/2007 | Asano et al. | |
| 2011/0181379 | A1* | 7/2011 | Sohn ..... | H01H 71/04 335/17 |
| 2012/0181152 | A1 | 7/2012 | Carlino et al. | |

FOREIGN PATENT DOCUMENTS

| | | |
|---|---|---|
| EP | 0437220 | 7/1991 |
| JP | 2013026223 | 2/2013 |
| KR | 1020110087927 | 8/2011 |

OTHER PUBLICATIONS

European Patent Office Application Serial No. 15158385.3, Search Report dated Aug. 3, 2015, 5 pages.
Korean Intellectual Property Office Application No. 10-2014-0031216, Office Action dated Aug. 18, 2017, 6 pages.

* cited by examiner

MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2014-0031216, filed on Mar. 17, 2014, the contents of which is incorporated by reference herein in its entirety.

BACKGROUND OF THE INVENTION

1. Field of the Invention

The present disclosure relates to molded case circuit breaker and particularly, to the molded case circuit breaker (abbreviated as MCCB hereinafter) having a fault indicating relay.

2. Background of the Invention

A MCCB is an electric power device which includes a trip mechanism and a switching mechanism and is used to switch and protect a relatively low voltage circuit of hundreds of volts by detecting an overcurrent equivalent to about 120 percent of a rated current, an instantaneous current (i.e., a very large current to be broken instantaneously) corresponding to a few times to tens of times the rated current, flowing in an electric power circuit (abbreviated as circuit hereinafter), or a ground fault current occurring as at least one pole of current, among three poles, leaks to a ground. Namely, when the overcurrent or the instantaneous current to be broken instantaneously flows or the ground fault current flows, the trip mechanism triggers the switching mechanism to move to a circuit breaking (so-called trip) position, and the switching mechanism, triggered by the trip mechanism, is driven to a trip position in which a movable contact is automatically separated from a corresponding fixed contact, or driven to an ON position in which a movable contact of the circuit is brought into contact with a corresponding fixed contact according to user's manipulation of a switching operation handle to close the circuit.

If such an MCCB, when performing a trip operation (namely, automatic circuit breaking) due to an overcurrent, an instantaneous current, or a ground fault current, may indicate the accident cause of the overcurrent, the instantaneous current, or the ground fault current, the accident cause may be promptly removed and an electric power may be supplied again to an electric load to perform re-operation, shortening a time taken from a power failure to a normal load operation.

Thus, as illustrated in FIGS. 1 and 2, a related art MCCB 100 includes an electronic trip unit 30 detecting an overcurrent, an instantaneous current, or a ground fault current and triggering a switching mechanism to move to a circuit breaking (or tripping) position. The electronic trip unit 30 includes a fault type indication light emitting diode (abbreviated as LED hereinafter) 31 indicating a type of an accident current.

However, according to the method of indicating a type of an accident current through the fault type indication LED 31 provided in the electronic trip unit 30 of the related art MCCB 100 illustrated in FIGS. 1 and 2, a user should check or view the fault type indication LED 31 to check an accident cause, causing user inconvenience, and in particular, in a case in which the MCCB 100 is installed within an outer case with a door, such as a power dividing box or a power distributing cabinet, such inconvenience is aggravated.

In addition, in order to transmit an fault type indication command signal from the electronic trip unit 30 of the MCCB 100 to a front indication operation panel of an enclosure of the power dividing box or the power distributing cabinet or to a remote monitoring system, a transceiver unit for communication needs to be provided in the electronic trip unit 30 and complicated transmission and reception lines based on a communication scheme needs to be installed, increasing manufacturing cost of the MCCB 100, and installation of the transmission and reception lines causes an operation of a considerable amount of time and an installation space for a user, which is, thus, burdensome.

SUMMARY OF THE INVENTION

Therefore, an aspect of the detailed description is to provide a molded case circuit breaker (MCCB) eliminating the necessity to install a communication unit and a particular communication medium and allowing for checking an fault type from a front indication operation panel of an enclosure of a power distributing cabinet or from a remote area by simply connecting two signal lines for transmitting a relay switching signal as an accident current indication signal.

To achieve these and other advantages and in accordance with the purpose of this specification, as embodied and broadly described herein, a molded case circuit breaker including an electronic trip unit for determining whether a fault current of an overcurrent, an instantaneous current, or a ground fault current has occurred and providing an indication command signal of the fault current, the molded case circuit breaker comprising:

a relay assembly including a plurality of fault indicating relays installed in the molded case circuit breaker and configured to generate a fault current indication signal by opening or closing a contact when the indication command signal of a fault current is received from the electronic trip unit, and a signal output terminal configured to output a fault type indication signal of the fault indicating relays to the outside of the molded case circuit breaker, the relay assembly being configured as a single module detachably attached to the interior of the molded case circuit breaker.

According to an aspect of the present disclosure, the relay assembly may comprise:

a plurality of fault indicating relays opened or closed when the indication command signal is received from the electronic trip unit;

a printed circuit board that allows the fault indicating relays to be mounted thereon and electrically connected thereto, and electrically connected to the electronic trip unit;

the signal output terminal electrically connected to the printed circuit board to transmit the fault current indication signal according to opening or closing of the fault indicating relay to outside of the molded case circuit breaker;

a case having an open upper portion and that encloses the fault indicating relays, the printed circuit board, and the signal output terminal; and a cover having a signal line connection hole portion exposing the signal output terminal outwardly in order to allow the signal output terminal to be connected to an external signal line, and that covers the case.

According to another aspect of the present disclosure, the molded case circuit breaker may further comprise: a connector for connecting the printed circuit board and the electronic trip unit in order to receive the indication command signal from the electronic trip unit.

According to still another aspect of the present disclosure, the fault indicating relays comprises two relays as a selective combination of the overcurrent indication relay and the instantaneous current indication relay or ground fault indicating relay.

According to still another aspect of the present disclosure, the fault indicating relays comprises three relays including the overcurrent indication relay, the instantaneous current indication relay, and the ground fault indicating relay.

According to still another aspect of the present disclosure, the signal output terminal comprise:

a first switching signal output terminal of the overcurrent indication relay among the fault indicating relays;

a common terminal; and a second switching signal output terminal of the instantaneous current indication relay or the ground fault indicating relay among the fault indicating relays.

According to still another aspect of the present disclosure, the molded case circuit breaker has an accessory device installation space portion formed as a recess portion in an upper portion adjacent to the electronic trip unit to receive the fault indicating relays therein, and the relay assembly is installed in the accessory device installation space portion.

According to still another aspect of the present disclosure, the cover comprises a cover body portion, as a hexahedral portion with an open lower portion, including a quadrangular upper surface and front, rear and both lateral sides extending downwardly from the quadrangular upper surface, to cover the open upper portion of the case, and a plurality of elastic coupling pieces downwardly extending from the cover body portion and having hook portions formed on end portions thereof, and the case comprises a plurality of coupling hole portions provided on the lateral side of the case to correspond to the elastic coupling pieces and formed to extend downwardly such that the lateral surface of the case and the surfaces of the elastic coupling pieces become coplanar when the elastic coupling pieces are inserted According to still another aspect of the present disclosure, the cover and the case comprises position determining protrusion portions and the position determining recess portions into which the position determining protrusion portions are inserted in order to determine mutual coupling positions, respectively.

According to still another aspect of the present disclosure, a plurality of position determining protrusion portions and a plurality of position determining recess portions are provided, the position determining protrusion portions are disposed asymmetrically, and the position determining recess portions are also disposed asymmetrically.

According to still another aspect of the present disclosure, the case further comprises:

a guide plate portion extending to protrude forwardly to guide passing of a signal line connecting the printed circuit board and the electronic trip unit; and a guide opening portion formed to be spaced apart from the guide plate portion at a predetermined interval, facing the guide plate portion, on the front side of the case to guide passing of the signal line connecting the PCB and the electronic trip unit together with the guide plate portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 3:
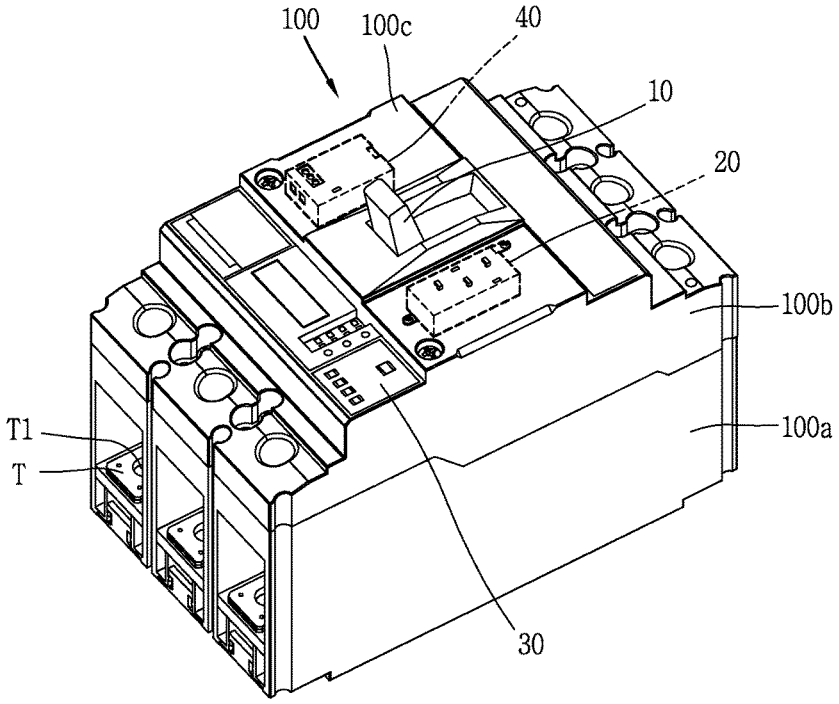
FIG. 3 is a perspective view illustrating an MCCB according to an embodiment of the present disclosure without an auxiliary cover.

Referring to FIG. 3, a molded case circuit breaker (MCCB) 100 according to an embodiment of the present disclosure comprises a main circuit section including a movable contact arm and a stationary contact arm for each of three phases (or three poles), namely, R, S, and T phases, a switching mechanism 10 providing switching power of the main circuit section, including a manually operated handle, a trip spring, a link mechanism, a latch mechanism for maintaining elastic energy of the trip spring in a charged state or releasing the elastic energy, and having a closing position (or an ON position) for closing a circuit, a manually opening position (or an OFF position) for manually opening the circuit, and a trip position for automatically opening the circuit; and an electronic trip unit 30 for triggering the switching mechanism 10 to move to the trip position when a fault current occurs in the circuit.

In order to receive or accommodate the switching mechanism 10 and the electronic trip unit 30, the MCCB 100 comprises a lower case 100*a* and an upper main cover 100*b*.

Also, in the MCCB 100 according to an embodiment of the present disclosure, a pair of accessory device installation space portions formed as recess portions to receive accessory devices in an upper portion adjacent to the electronic trip unit 30 are provided on both sides of the switching mechanism. As illustrated in FIG. 3, when a pair of auxiliary covers 100*c* are closed, the both accessory device installation space portions are not exposed outwardly.

The MCCB 100 according to an embodiment of the present disclosure comprises a relay assembly 40 as described hereinafter, and the relay assembly 40 may be installed in the accessory device installation space portions.

The electronic trip unit 30 may be configured to compare an amount of current detected by a current transformer (can be abbreviated as CT) devised to detect an amount of current of a circuit, with an overcurrent reference value previously set to be about 120 percent of a rated current and an instantaneous current reference value previously set to be a few times of the rated current by a control unit configured as a microprocessor, to determine whether an overcurrent or an instantaneous current has occurred.

Also, the electronic trip unit 30 may be configured to compare a ground fault detection signal detected by a zero phase current transformer (ZCT) (not shown) devised to detect a ground fault, with a ground fault determination reference value previously set by the control unit, to determine whether a ground fault has occurred.

Figure 4:
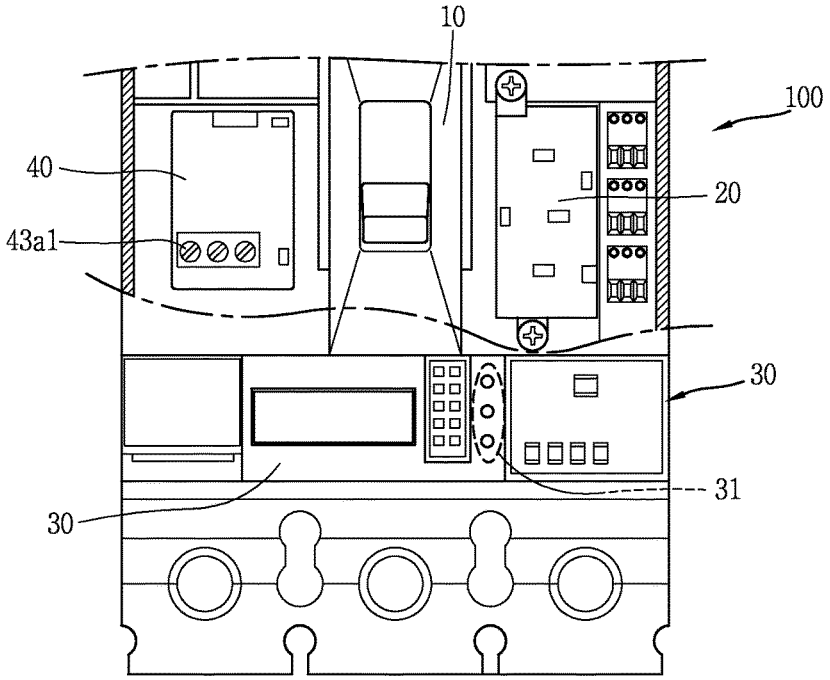
FIG. 4 is a partial plan view illustrating an electronic trip unit and a relay assembly of the MCCB of FIG. 3.

When it is determined that a fault current such as an overcurrent, an instantaneous current, or a ground fault has occurred, the electronic trip unit 30 magnetizes a trip coil of a n electromagnetic trip actuator (not shown) to trigger the switching mechanism 10 to move to the trip position, outputs a control signal to a corresponding fault type indication light emitting device 31 as illustrated in FIG. 4 to turn it on, and outputs an indication command signal of the fault current to the relay assembly 40 according to an embodiment of the present disclosure.

Figure 5:
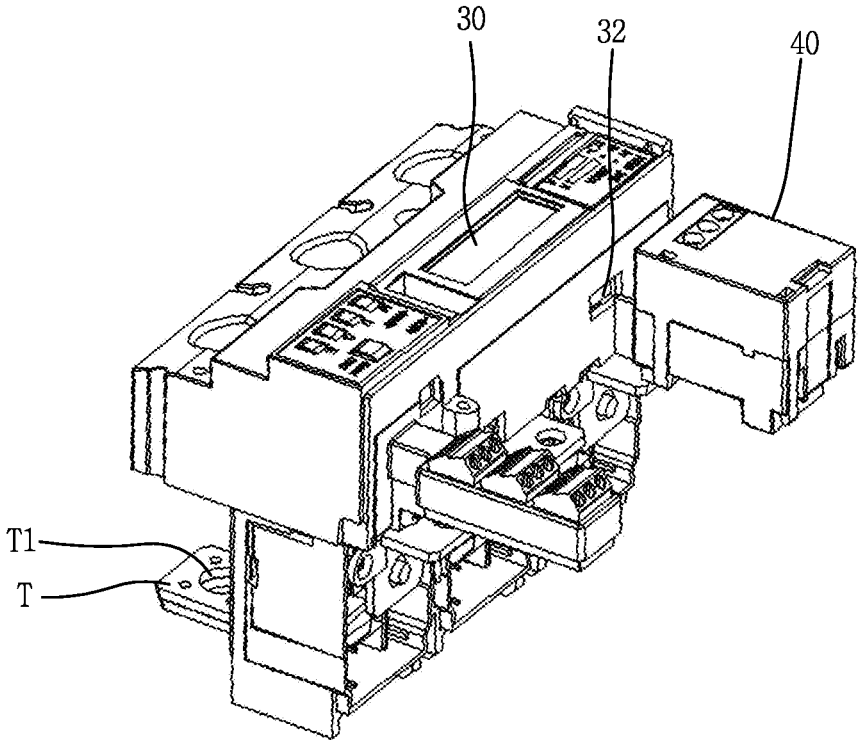
FIG. 5 is a partial perspective view of the electronic trip unit, the relay assembly, and a terminal unit of the MCCB according to an embodiment of the present disclosure.

As illustrated in FIG. 5, the electronic trip unit 30 may comprise a signal line through hole 32 allowing a signal line (not shown) of the indication command signal and a connector (not shown) to pass therethrough for a signal connection with the relay assembly 40, specifically, with a connector 50 (to be described hereinafter).

Here, the indication command signal may comprise a magnetizing signal with respect to a relay coil of the relay assembly 40.

The development and configuration of the electronic trip unit 30 have been in line with the development, manufacturing, and sale of an MCCB.

Figure 1:
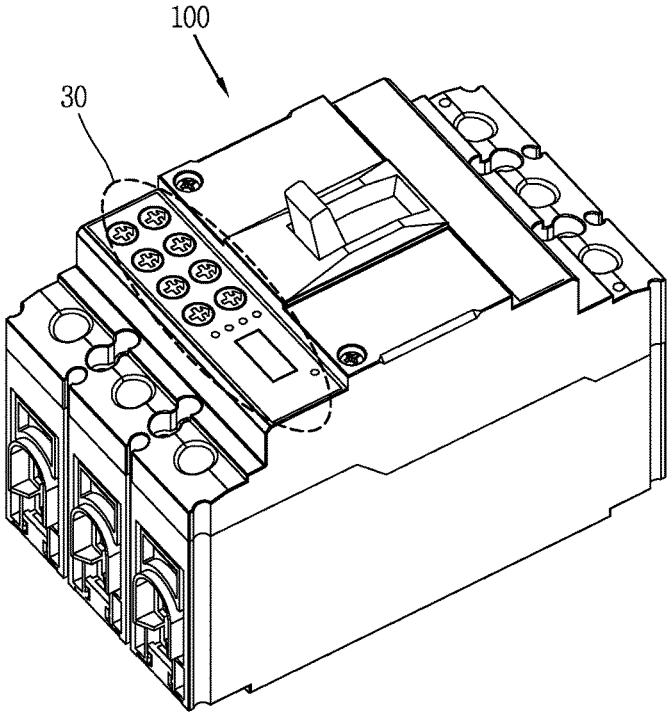
FIG. 1 RELATED ART
FIG. 1 is a perspective view of a molded case circuit breaker according to a related art.
Figure 2:
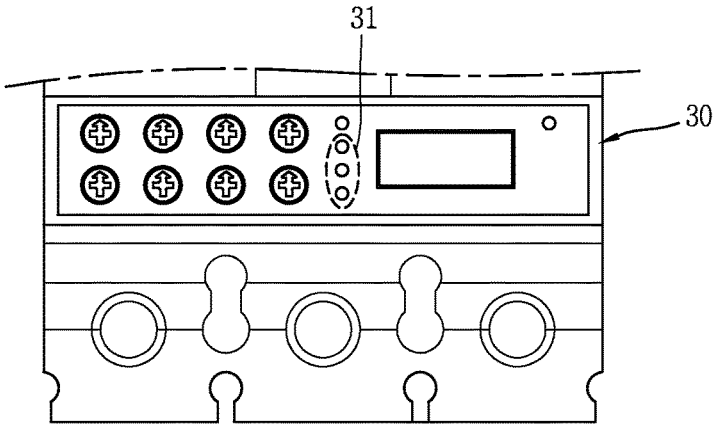
FIG. 2 RELATED ART
FIG. 2 is a plan view of an electronic trip unit of the MCCB according to the related art.

As an example of a related art document, the configuration of the accessory device installation space portion and the circuit configuration and operation of the electronic trip unit 30 may be referred to FIGS. 1B, 4, and 5 and descriptions of the configuration and operation related thereto of Korean Patent Registration No. 10-0509584 filed by the same applicant of the present invention.

In FIG. 3, reference numeral 20 designates a shunt trip device as an electromagnetic actuator, one of accessory devices, for transmitting a control signal from a remote area to trigger the switching mechanism to move to the trip position, or an under voltage trip mechanism as an electromagnetic actuator for triggering the switching mechanism to move to the trip position in response to a control signal from the control unit when a voltage of the circuit is lower than a predetermined set voltage. Reference character T designates a terminal unit for connection to a power source side or a load side of each phase, and reference character T1 designates a screw through hole allowing a connection screw for connecting the terminal unit T and a circuit line to penetrate therethrough.

A detailed configuration and operation of the relay assembly 40 of the MCCB according to an embodiment of the present disclosure will be described in detail with reference to FIGS. 3 through 10.

As illustrated in FIG. 3, the relay assembly 40 is installed in the MCCB 100. That is, the relay assembly 40 is installed in the accessory device installation space portion provided in the form of a recess in a lower portion of the auxiliary cover 100*c* provided on both sides of the switching mechanism 10 of the MCCB 100.

As illustrated in FIGS. 3 and 4, the relay assembly 40 may be configured as a single module and attached to or detached from the MCCB 100.

Figure 8:
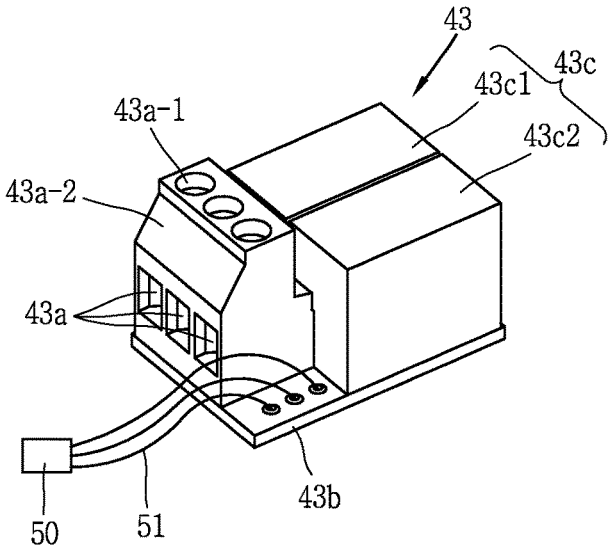
FIG. 8 is a perspective view of an assembly of an accident indication relay, a printed circuit board, and a signal output terminal of FIG. 6.

As illustrated in FIG. 8, the relay assembly 40 comprises a plurality of fault indicating relays 43*c* and signal output terminals 43*a* as terminal units.

When an indication command signal of a fault current is received from the electromagnetic trip unit 30, the plurality of fault indicating relays 43*c* open or close a contact to generate a fault current indication signal.

The signal output terminals 43*a* as terminal units provide means for outputting a fault type indication signal of the fault indicating relays 43*c* to outward of the MCCB 100. That is, a fault current type may be indicated by connecting a signal line to the signal output terminals 43*a* to emit a lamp on a front indication operation panel of an enclosure of a power distributing cabinet (console) (not shown), and may be transmitted to a remote managing and monitoring system through the signal line so as to be indicated.

As illustrated in FIGS. 6 through 9, the relay assembly 40 may comprise the fault indicating relays 43*c*, the printed circuit board (abbreviated as PCB hereinafter) 43*b*, the signal output terminals 43*a*, and a case 42 as an enclosure of the relay assembly 40, and a cover 41.

The fault indicating relay 43*c* may comprise a plurality of relays switched when the indication command signal is received from the electromagnetic trip unit 30.

According to an exemplary embodiment, as illustrated in FIG. 8, the fault indicating relays 43*c* may comprise two relays according to selective combination of an overcurrent indication relay 43*c*1 and an instantaneous current indication relay or a ground fault indicating relay 43*c*2.

That is, two relays are configured by combining the overcurrent indication relay 43*c*1 as a basic component for an overcurrent which occurs most frequently among fault currents and the instantaneous current indication relay or ground fault indicating relay 43*c*2 selected by the user by setting the electromagnetic trip unit 30. In this manner, according to an embodiment of the present disclosure, the instantaneous current generation indication function may be selected or a ground fault generation indication function may be selected by the user in addition to the indication of the basic overcurrent among types of fault currents.

In another embodiment, the fault indicating relays 43*c* may be configured as three relays including the overcurrent indication relay 43*c*1, an instantaneous current indication relay, and a ground fault current indication relay. According to the present embodiment, all of an overcurrent, an instantaneous current, and a ground fault, as generated may be indicated in a position spaced apart from the MCCB 100.

Figure 10:
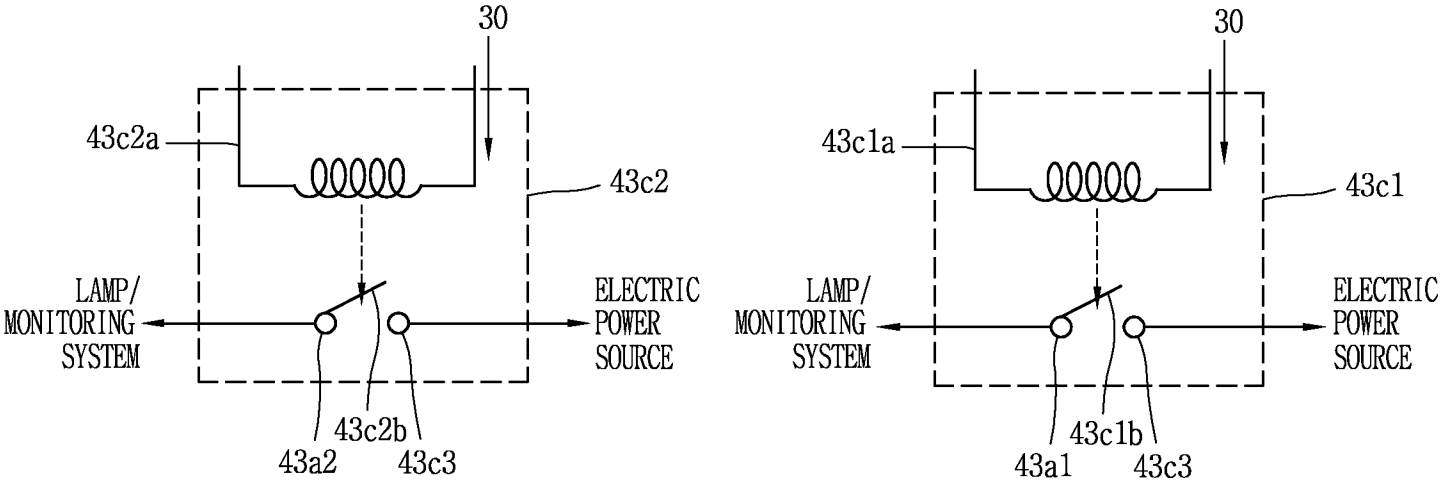
FIG. 10 is a circuit diagram illustrating the accident indication relay and an input/output relationship thereof in the MCCB according to an embodiment of the present disclosure.

The fault indicating relays 43*c* may generate a fault current indication signal as a switching signal. That is, as illustrated in FIG. 10, when there is no indication command signal from the electromagnetic trip unit 30 so a relay coil

43*c*1*a* of the overcurrent indication relay 43*c*1, among the fault indicating relays 43*c*, or a relay coil 43*c*2*a* of an instantaneous current indication relay or ground fault current indication relay 43*c*2*b*, among the fault indicating relays 43*c*, is demagnetized and a relay contact red b or a relay contact 43*c*2*b* of each relay is open, a fault current indication signal is not generated. On the other hand, when the indication command signal is received from the electromagnetic trip unit 30 so the relay coil 43*c*1*a* or the relay coil 43*c*2*a*, among the fault indicating relays 43*c*, is magnetized by the corresponding indication command signal and the relay contact 43*c*2*b* or the relay contact 43*c*1*b* of the fault indicating relay 43*c* is closed, an electric power source is connected to the signal output terminal 43*a* through the relay contact 43*c*2*b* or the relay contact 43*c*1*b* and a fault current indication signal having a predetermined voltage may be output to the lamp on the front indication operation panel of the enclosure of the power distributing cabinet (not shown) or the remote managing and monitoring system through a signal line.

As illustrated in FIG. 8, the PCB 43*b* is configured as a board on which the fault indicating relay 43*c* is mounted and electrically connected. The PCB 43*b* is electrically connected to the electromagnetic trip unit 30.

As illustrated in FIG. 8, the signal output terminals 43*a* provide a means for connecting an external signal line (not shown) electrically connected to the PCB 43*b* an transmitting a fault current indication signal to outward of the MCCB 100 according to switching of the fault indicating relay 43*c*.

The signal output terminals 43*a* may be configured as electrically conductive bus bars such as the terminal unit T illustrated in FIG. 3, and comprise a switching signal output terminal 43*a*1 including a terminal connection screw for maintaining the signal line in a state of being tightly attached to the terminal units 43*a* by the screw head to maintain the connection state between the signal line and the signal output terminal 43*a*.

As illustrated in FIG. 8, the signal output terminals 43*a* may be configured to be covered by a terminal cover 43*a*-2. In order to minimize an outwardly exposed portion, except for three front openings (no reference numerals are given) to which signal lines may be connected and three upper openings 43*a*-1 allowing a screw driver to approach the terminal connection screw 43*a*1, the terminal cover 43*a*-2 is prepared to cover four sides, namely, upper, lower, left and right sides of the signal output terminals 43*a*.

As illustrated in FIG. 10, the signal output terminals 43*a* may comprise the switching signal output terminal 43*a*1 of the overcurrent indication relay 43*c*1 among the fault indicating relays 43*c*, among the fault indicating relays 43*c*, a common terminal 43*c*3, and the switching signal output terminal 43*a*2 of the instantaneous current indication relay or ground fault indicating relay 43*c*2 among the fault indicating relays 43*c*.

In FIG. 10, reference numeral 43*c*1*a* designates the relay coil of the overcurrent indication relay 43*c*1, reference numeral 43*c*1*b* designates the relay contact of the overcurrent indication relay 43*c*1, and reference numeral 43*c*3 designates a common terminal connected to the power source described above.

In FIG. 10, reference numeral 43*c*2*a* designates the relay coil of the instantaneous current indication relay or ground fault indicating relay 43*c*2, reference numeral 43*c*2*b* designates a relay contact of the instantaneous current indication relay or ground fault indicating relay 43*c*2, and reference numeral 43*c*3 designates the common terminal connected to the electric power source described above.

In FIG. 8, reference numeral 43 designates a relay half-assembly excluding the outer case unit (enclosure unit) in the relay assembly 40.

Also, the MCCB 100, in more detail, the relay assembly 40, according to an embodiment of the present disclosure may further comprise a connector 50 for connecting the PCB 43*b* and the electronic trip unit 30 in order to receive the indication command signal from the electromagnetic trip unit 30.

In FIG. 8, reference numeral 51 designates signal lines connecting the connector 50 and the PCB 43*b*.

Figure 6:
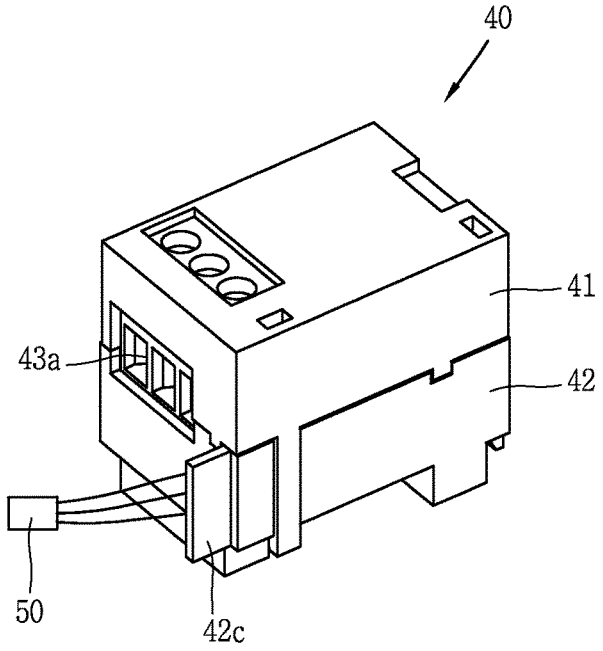
FIG. 6 is a perspective view illustrating an assembled state of a relay assembly of the MCCB according to an embodiment of the present disclosure.

A configuration of the case 42 and the cover 41 as an outer case part of the relay assembly 40 will be described with reference to FIGS. 6, 7, and 9.

The case 42, when an upper portion thereof is opened, provides a means for receiving the fault indicating relay 43*c*, the PCB 43*b*, and the signal output terminals 43*a*.

The cover 41 provides a means for covering the case 42. As illustrated in FIG. 7, the cover 41 comprises a cover body portion 41*b* having a substantially rectangular parallelepiped shape, a signal line connection hole portion 41*b*3, a terminal screw approach opening portion 41*b*1, a position determining protrusion portion 41*b*2, and a plurality of elastic coupling pieces 41*a*.

The cover body portion 41*b* has a quadrangular upper surface as a portion having a rectangular shape with an open lower portion and front, rear and both lateral sides extending downwardly from the quadrangular upper surface, thereby providing a means for covering the upper open portion of the case 42.

The signal line connection hole portion 41*b*3 provides a means for exposing the signal output terminals (please refer to 43*a* of FIG. 6) in order to connect the signal output terminals 43*a* to the external signal line.

Figure 7:
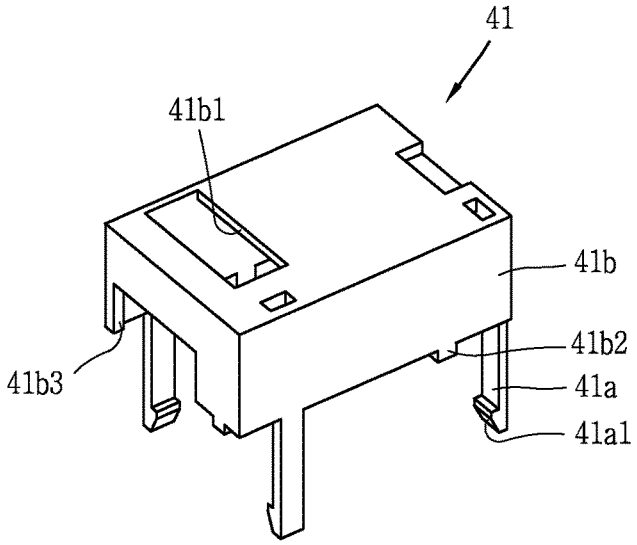
FIG. 7 is a perspective view of a cover of the relay assembly of FIG. 6.

According to an embodiment illustrated in FIG. 7, the signal line connection hole portion 41*b*3 may be provided in a lower portion of a front side of the cover 41. The signal line connection hole portion 41*b*2 may have a rectangular shape with an open lower portion.

Also, according to an embodiment of the present disclosure, the terminal screw approach opening portion 41*b*1 may be provided on one side of an upper portion, as a means allowing for a screw driver to pass therethrough to tighten or loosen the terminal connection screw (refer to 43*a*1 of FIG. 4) in order to connect the external signal line and the signal output terminals 43*a*. Here, according to an embodiment, the terminal screw approach opening portion 41*b*1 may be provided as a rectangular opening.

The position determining protrusion portion 41*b*2 may be provided as a means for determining coupling positions of the cover 41 and the case 42. As illustrated in FIG. 7, the position determining protrusion portion 41*b*2 is provided in the cover 41. A position determining recess portion 42*b* is provided in the case 42 corresponding to the position determining protrusion portion 41*b*2. Conversely, the position determining protrusion portion may be provided in the case 42, and the position determining recess portion may be provided in the cover 41 in a modified exemplary embodiment.

As illustrated in FIG. 7, the position determining protrusion portion 41*b*2 may extend downwardly from one lower portion or from both lower portions of the cover body portion 41*b*, and may also be provided on the front or rear surface or on the front and rear surfaces of the cover body portion 41*b*.

In particular, in order to prevent mutual coupling positions of the cover 41 and the case 42 from being exchanged, according to an embodiment, a plurality of position determining protrusion portions 41*b*2 are provided, and here, the position determining protrusion portions 41*b*2 are disposed asymmetrically. For example, two position determining protrusion portions 41*b*2 may be provided and each of the position determining protrusion portions 41*b*2 may be disposed to be different in distances from the rear surface of the cover body portion 41*b*.

The plurality of elastic coupling pieces 41*a* extend downwardly from the cover body portion 41*b*, and have a hook portion 41*a*1 in an end portion thereof.

According to an embodiment, the plurality of elastic coupling pieces may be three ones, and two elastic coupling piece may be provided respectively on both sides close to the front side of the cover body portion 41*b* and one elastic coupling piece may be provided on one corner of the rear side.

Figure 9:
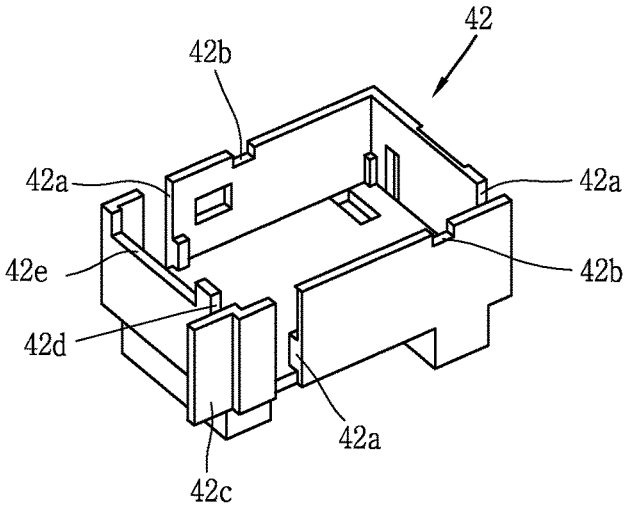
FIG. 9 is a perspective view of a case of the relay assembly of FIG. 6.

As illustrated in FIG. 9, the case 42 is configured substantially as a rectangular parallelepiped member with an open upper portion, and has a plurality of coupling hole portions 42*a* and a plurality of position determining recess portions 42*b*.

The plurality of coupling hole portions 42*a* of the case 42 may be provided on the side of the case 42 corresponding to the elastic coupling pieces 41*a*. In other words, the plurality of coupling hole portions 42*a* are formed as a total of three coupling hole portions including two coupling hole portions formed on both sides close to the front side of the case 42 and one coupling hole portion formed at the corner of the rear side of the case 42, corresponding to the elastic coupling pieces 41*a*.

The upper and lower portions of the coupling hole portions 42*a* are opened and formed to extend downwardly such that the lateral surfaces of the case 42 and the surfaces of the elastic coupling pieces 41*a* form a single plane when the elastic coupling pieces 41*a* are inserted. Also, the coupling hole portions 42*a* may have a width having a tolerance in addition to the width of the elastic coupling pieces 41*a* such that the elastic coupling pieces 41*a* are inserted thereinto.

As described above, the plurality of position determining recess portions 42*b* are provided to correspond to the position determining protrusion portions 41*b*2. Each of the position determining protrusion portions 412*b* are disposed to be asymmetrical, and each of the position determining recess portions 42*b* are also asymmetrically disposed such that mutual coupling positions are not changed in the cover 41 and the case 42. In other words, according to an embodiment, two position determining recess portions 42*b* may be provided and the position determining recess portions 42*b* may be disposed at different distances from the rear side of the case 42.

As illustrated in FIG. 9, the case 42 may have a plurality of support protrusion portions (no reference numerals are given) protruding from inner wall surfaces at a predetermined height close to the inner bottom surface in order to support the PCB 43*b* as illustrated In FIG. 8.

As illustrated in FIG. 9, the case 42 comprises a guide plate unit 42*c* for guiding passing of the signal lines 51 connecting the connector 50 and the PCB 43*b* and a guide opening portion 42*d* formed in a vertical direction on the front side of the case 42, spaced apart from the guide plate unit 42*c* by a predetermined interval, facing the guide plate unit 42*c*, and for guiding passing of the connector 50 and the signal lines 51 together with the guide plate unit 42*c*.

A position determining protrusion portion (no reference numeral is given) provided on the front side of the cover body portion 41*b* may be inserted into an upper space between the guide plate portion 42*c* and guide opening 42*b* facing the guide plate unit 42*c* so as to be installed.

As illustrated in FIG. 9, the case 42 comprises a signal line connection hole portion 42*e* having a rectangular shape with an open upper portion and provided to correspond to the signal line connection hole portion 41*b*3 of the cover 41 in order to form a signal line connection hole together with the signal line connection hole portion 41*b*3 of the cover 41 described above.

A method for assembling the fault indicating relays and installing the assembled fault indicating relays in the MCCB according to an embodiment of the present disclosure configured described above will be describe with reference to the accompanying drawings.

First, one of an instantaneous current indication relay or a ground fault indicating relay is selected as a fault indicating relay to be combined with the overcurrent indication relay 43*c*1 by using a setting unit of the electronic trip unit 30 and set to output the indication command signal when the electronic trip unit 30 detects an overcurrent, an instantaneous current, or a ground fault. The set value is stored.

Next, the overcurrent indication relay 43*c*1, the instantaneous current indication relay or a ground fault indicating relay 43*c*2, the signal output terminal 43*a*, the terminal cover 43*a*-2, the signal lines 51, and the connector 50 are installed on the PCB 43*b* to obtain the assembly of the fault indicating relay 43, the PCB 43*b*, and the signal output terminal 43*a* illustrated in FIG. 8.

Thereafter, assembly of the fault indicating relay 43, the PCB 43*b*, and the signal output terminals 43*a* are received in the case 42 as illustrated in FIG. 9. Here, the PCB 43*b* is mounted on the plurality of support protrusion portions within the case 42, and the signal lines 51 and the connector are drawn out through the opening between the guide plate portion 42*c* and the guide opening portion 42*d*.

Thereafter, the cover 41 as illustrated in FIG. 7 is assembled to the case 42. That is, the position determining protrusion portions 41*b*2 of the cover 41 are aligned to be inserted into the position determining recess portions 42*b* of the case 42, and the plurality of elastic coupling pieces 41*a* of the cover 41 corresponding to the plurality of coupling hole portions 42*a* of the case 42 are aligned and pushed down until when the hook portions 41*a*1 formed on the lower end portions of the elastic coupling pieces 41*a* are elastically coupled to a lower surface of the case 42. Here, when the elastic coupling pieces 41*a* are completely inserted, the lateral surfaces 42 of the case 42 and the surface of the elastic coupling pieces 41*a* are coplanar. Also, the signal line connection hole portion 41*b*3 of the cover 41 and the signal line connection hole portion 42*e* of the case 42 are aligned to form a signal line connection hole on the front side. Accordingly, the fault indicating relay assembly as illustrated in FIG. 6 is obtained.

Thereafter, as illustrated in FIGS. 3 through 5, the auxiliary cover 100*c* of the MCCB 100 is unscrewed and the relay assembly 40 is installed in the accessory installation space portion appearing in the form of a recess portion.

Here, as illustrated in FIG. 5, when a signal line (not shown) of the indication command signal drawn out through the signal line through hole 32 of the electronic trip unit 30 is connected to the connector (not shown) and the connector 50 of the relay assembly 40, the electrical and mechanical connection for signal transmission of the electronic trip unit 30 and the relay assembly 40 are completed.

Here, the connector of the electronic trip unit 30 and the connector 50 of the relay assembly 40 are configured as a pin connector including a plurality of conductive pins and an insulating housing covering the plurality of conductive pins and a hole connector having a conductive inner wall provided within a plurality of recesses and having the outside covered by an insulating housing, respectively, whereby the connector of the electronic trip unit 30 and the connector 50 of the relay assembly 40 may be connected in a male-and-female coupling manner.

Thereafter, the auxiliary cover 100*c* is closed and a screw for maintaining blocking of the auxiliary cover 100*c* is fastened, thus completing the assembling and installation operation of the relay assembly 40.

The operation of the MCCB including the fault indicating relay according to an embodiment of the present disclosure configured, assembled, and installed as described above will be described with reference to FIGS. 3 through 10.

In a state in which the MCCB 100 according to an embodiment of the present disclosure is connected to the electric power circuit, a control unit (not shown) configured as a microprocessor of the electronic trip unit 30 illustrated in FIGS. 3 through 5 compares an amount of current detected by a current transformer (not shown), which serves to detect an amount of current of a circuit, with an overcurrent reference value previously set to be about 120 percent of a rated current and an instantaneous current reference value previously set to be a few times the rated current to determine whether of an overcurrent or an instantaneous current has occurred.

Also, in the electronic trip unit 30, in order to detect a ground fault, the controller compares a ground fault detection signal detected by the ZCT with a preset ground fault determination reference value to determine whether a ground fault has occurred.

When it is determined that a fault current such as an overcurrent, an instantaneous current, or a ground fault, has occurred, the electronic trip unit 30 magnetizes a trip coil of an electromagnetic trip actuator to trigger the switching mechanism 10 to move to a trip position, outputs a control signal to the corresponding fault type indication light emitting device 31 as illustrated in FIG. 4 to turn it on, and outputs an indication command signal of the fault current to the relay assembly 40.

Such an indication command signal is delivered to the connector 50 of the relay assembly 40 through the signal line and the connector (not shown) described above, and also delivered to the overcurrent indication relay 43*c*1 or the instantaneous current indication relay or ground fault current indication relay 43*c*2 through the signal lines 51 and the PCB 43*b* of FIG. 8.

For example, when the indication command signal is a signal commanding an overcurrent indication, the relay coil 43*c*1*a* of the overcurrent indication relay 43*c*1 illustrated in FIG. 10 is magnetized, and the relay contact 43*c*1*b* is closed by magnetic force of the magnetized relay coil 43*c*1*a*. Accordingly, a current from a power source may flow from the common terminal 43*c*3 to the overcurrent generation indication lamp attached to the front indication operation panel of the power distributing cabinet (not illustrated) through the switching signal output terminal 43*a*1 of the overcurrent indication relay 43*c*1 of the signal output terminals 43*a* to turn on the corresponding lamp to thus issue a warning outwardly about the generation of the overcurrent, or the current may be transmitted to a remote monitoring system to drive an alarm indication unit such as a buzzer, a lamp, or a monitor of the remote monitoring system.

When the indication command signal is a signal commanding indication of generation of an instantaneous current or a ground fault, the relay coil 43*c*2*a* of the instantaneous current indication relay or ground fault indicating relay 43*c*2 is magnetized, and the relay contact 43*cb*2 is closed by magnetism of the magnetized relay coil 43*c*2*a*. Accordingly, a current from an electric power source may flow from the common terminal 43*c*3 to the instantaneous current generation indication lamp or ground fault generation indication lamp attached to the front indication operation panel of the power distributing cabinet (not illustrated) through the switching signal output terminal 43*a*2 of instantaneous current indication relay or ground fault indicating relay 43*c*2 of the signal output terminals 43*a* to turn on the corresponding lamp to thus issue a warning outwardly about the generation of the instantaneous current or the ground fault, or the current may be transmitted to the remote monitoring system to drive the alarm indication unit such as a buzzer, a lamp, or a monitor of the remote monitoring system.

As described above, since the MCCB 100 according to an embodiment of the present disclosure has the plurality of fault indicating relays 43*c* installed and generating a fault current indication signal by opening or closing a contact when an indication command signal of a fault current is received from the electronic trip unit 30 and the terminal unit (or the signal output terminal) 43*a* and comprises the relay assembly 40 configured as a single module detachably attached to the interior of the MCCB 100, the MCCB 100 may transmit a fault current indication signal of the fault indicating relay 43*c* to the outside of the MCCB 100 through the signal line connected to the terminal unit 43*a* to turn on a lamp on the front indication operation panel of the enclosure of the power distributing cabinet to indicate a fault current type, and may transmit the signal to the remote monitoring system through the signal line to indicate a fault current type.

Thus, the user may conveniently check a cause of a trip from the front indication operation panel of the power distributing cabinet or from a remote are, without having to directly access the MCCB 100 to check the cause of the trip.

As described above, since the MCCB according to an embodiment of the present disclosure comprises the relay assembly including the plurality of fault indicating relays installed to be embedded and generating a fault current indication signal by opening or closing a contact when an indication command signal of a fault current is received from the electronic trip unit 30 and the terminal unit outputting a fault type indication signal of the fault indicating relays to the outside of the MCCB, and configured as a single module detachably attached to the interior of the MCCB, the MCCB may transmit a fault current indication signal of the fault indicating relay to the outside through the signal line connected to the terminal unit to turn on a lamp on the front indication operation panel of the enclosure of the power distributing cabinet to indicate a fault current type, and may transmit the signal to the remote monitoring system through the signal line to indicate a fault current type, and thus, the user may conveniently check a cause of a trip from the front indication operation panel of the power distributing cabinet or from a remote are, without having to directly access the MCCB 100 to check the cause of the trip.

In the MCCB according to an embodiment of the present disclosure, the relay assembly comprises: a plurality of fault indicating relays; a PCB allowing the fault indicating relays to be mounted on and electrically connected thereto, and electrically connected to an electronic trip unit; signal output terminals electrically connected to the PCB to transmit a fault current indication signal according to opening and closing of the fault indicating relay outwardly; a case having an open upper portion and receiving the PCB and the signal output terminals; and a cover having a signal line connection hole portion exposing the signal output terminals outwardly in order to allow the signal output terminals to be connected to an external signal line, and covering the case. And thus, since the fault indicating relays are accommodated within the enclosure composed of the case and the cover, forming a unit, the structure (or configuration) for installing the fault indicating relays in the MCCB can be simplified.

The MCCB according to an embodiment of the present disclosure further comprises a connector for signal-connecting the PCB and the electronic trip unit in order to receive the information signal from the electronic trip unit. Thus, the PCB and the electronic trip unit can be simply connected by the connector, enhancing productivity of the MCCB.

In the MCCB according to an embodiment of the present disclosure, since the fault indicating relays comprise two relays as a selective combination of the overcurrent indication relay and the instantaneous current indication relay or ground fault indicating relay, the user may select the instantaneous indication function or the ground fault indication function, in addition to the basic overcurrent indication function among fault types.

In the MCCB according to an embodiment of the present disclosure, since the fault indicating relays comprise three relays; namely, the overcurrent indication relay, the instantaneous current indication relay, and the ground fault indicating relay, both the overcurrent and the instantaneous current and the ground fault can be indicated.

In the MCCB according to an embodiment of the present disclosure, since the signal output terminals comprise the switching signal output terminal of the overcurrent indication relay among the fault indicating relays, a single common terminal, and the switching signal output terminal of the instantaneous current indication relay or the ground fault indicating relay among the fault indicating relays, one end of each of two signal lines may be connected to the common terminal and the switching signal output terminal of the overcurrent indication relay and the other end of each of the two signal lines may be connected to the lamp of the front indication operation panel of the power distributing cabinet or to the monitoring system (remote monitoring system) to indicate a fault cause current of an overcurrent, and one end of each of other two signal lines may be connected to the common terminal and the switching signal output terminal of the instantaneous current indication relay or ground fault indicating relay and the other end thereof may be connected to the lamp of the front indication operation panel or to the remote monitoring system to indicate a fault cause current of an instantaneous current.

The MCCB according to an embodiment of the present disclosure has the accessory device installation space portion formed as a recess portion in an upper portion adjacent to the electronic trip unit to receive the fault indicating relays therein, and the relay assembly is installed in the accessory device installation space portion. Thus, the relay assembly can be simply put into the accessory device installation space portion as the recess portion so as to be installed.

In the MCCB according to an embodiment of the present disclosure, the cover comprises the cover body portion with an open lower portion having a quadrangular upper surface and front, rear and both lateral sides extending downwardly from the quadrangular upper surface, to cover the upper open portion of the case, and a plurality of elastic coupling pieces downwardly extending from the cover body portion and having hook portions formed on end portions thereof, and the case comprises a plurality of coupling hole portions provided on the lateral side of the case to correspond to the elastic coupling pieces and formed to extend downwardly such that the lateral surface of the case and the surfaces of the elastic coupling pieces become coplanar when the elastic coupling pieces are inserted. Thus, when the elastic coupling pieces of the cover are inserted into the coupling hole portions of the case, the elastic coupling pieces form a plane, rather than protruding from the surface, and thus, the fault indicating relay assembly can be reduced in size and can be easily received and installed in the MCCB without causing interference.

In the MCCB according to an embodiment of the present disclosure, since the cover and the case comprise the position determining protrusion portions and the position determining recess portions into which the position determining protrusion portions are inserted in order to determine mutual coupling positions, the cover and the case can be accurately coupled without causing changes in front, rear, left, and right sides.

In the MCCB according to an embodiment of the present disclosure, a plurality of position determining protrusion portions and a plurality of position determining recess portions are provided, the position determining protrusion portions are disposed asymmetrically, and the position determining recess portions are disposed asymmetrically. Thus, the cover and the case can be accurately coupled without causing changes in front, rear, left, and right sides.

In the MCCB according to an embodiment of the present disclosure, since the case further comprises the guide plate portion extending to protrude forwardly to guide passing of the signal line connecting the PCB and the electronic trip unit and the guide opening portion formed to face the guide plate portion to guide passing of the signal line connecting the PCB and the electronic trip unit together with the guide plate portion, the signal line and the connector can be easily drawn out from the case through the corresponding guide plate portion and the guide opening portion, and thus, an operation of connection to the connector and the electronic trip unit can be facilitated and quickly and accurately performed.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker comprising:

an electronic trip unit configured to determine that a fault current has occurred and provide an indication of the determined fault current; and a relay assembly configured as a single module detachably attached to an interior of the molded case circuit breaker, the relay assembly comprising:

a plurality of fault indicating relays configured to generate a fault current indication signal by opening or closing a contact when the indication of the determined fault current is received;

a printed circuit board (PCB) which the plurality of fault indicating relays mounted thereon, the PCB electrically connected to the plurality of fault indicating relays and the electronic trip unit;

a signal output terminal electrically connected to the PCB and configured to externally transmit the generated fault current indication signal;

a case comprising an open upper portion that encloses the plurality of fault indicating relays, the PCB and the signal output terminal; and a cover that covers the case and comprises a signal line connection hole configured to externally expose the signal output terminal connection to an external signal line.

2. The circuit breaker of claim 1, further comprising a connector configured to connect the PCB to the electronic trip unit in order to receive the indication of the determined fault current.

3. The circuit breaker of claim 1, wherein the plurality of fault indicating relays comprises two of an overcurrent indication relay, an instantaneous current indication relay and a ground fault indication relay.

4. The circuit breaker of claim 1, wherein the plurality of fault indicating relays comprises an overcurrent indication relay, an instantaneous current indication relay and a ground fault indication relay.

5. The circuit breaker of claim 1, wherein the signal output terminal comprises:

a first switching signal output terminal of an overcurrent indication relay of the plurality of fault indication relays;

a common terminal; and a second switching signal output terminal of an instantaneous current indication relay of a ground fault indication relay of the plurality of fault indicating relays.

6. The circuit breaker of claim 1, further comprising an accessory device installation portion formed as a recess in an upper portion adjacent to the electronic trip unit wherein the plurality of fault indicating relays and the relay assembly are installed in the accessory device installation portion.

7. The circuit breaker of claim 1, wherein:

the cover further comprises a quadrangular upper surface, an open hexahedral body portion with an open lower portion that covers the open upper portion of the case and a plurality of elastic coupling pieces each extending downward from the hexahedral body portion with a hook portion formed on its end portion;

the case further comprises a plurality of coupling hole portions provided on a lateral side to correspond to the plurality of elastic coupling pieces and extending downward such that a lateral surface of the case and surfaces of the plurality of elastic coupling pieces are coplanar when the plurality of elastic coupling pieces are inserted; and front, rear and lateral sides extend downward from the quadrangular upper surface.

8. The circuit breaker of claim 1, wherein the cover and the case each further comprises at least one position determining protrusion portion and at least one position determining recess portion into which the at least one position determining protrusion portion is inserted in order to determine respective mutual coupling positions.

9. The circuit breaker of claim 8, wherein:

the cover and the case each further comprises a plurality of asymmetrically located position determining protrusion portions and a plurality of asymmetrically located position determining recess portions.

10. The circuit breaker of claim 1, wherein the case further comprises:

a forward extending guide plate portion configured to guide passage of a signal line connecting the PCB to the electronic trip unit; and a guide opening portion on a front side of the case configured to guide passage of the signal line, the guide opening portion facing the guide plate portion and spaced apart from the guide plate portion at a predetermined interval.

* * * * *